United States Patent [19]

Mayer

[11] Patent Number: 4,764,185

[45] Date of Patent: Aug. 16, 1988

[54] GASIFIER APPARATUS

[76] Inventor: Edward F. Mayer, 355 Countryclub Boulevard, Winnipeg, Manitoba, Canada, R3K-1X4

[21] Appl. No.: 117,090

[22] Filed: Oct. 28, 1987

[51] Int. Cl.[4] ..... C10J 3/26

[52] U.S. Cl. ..... 48/76; 48/63; 48/111

[58] Field of Search ..... 48/62, 63, 64, 66, 76, 48/86 R, 111, 67, 68, 69; 110/229

[56] References Cited

U.S. PATENT DOCUMENTS

| | | | |
|---|---|---|---|
| 1,523,163 | 1/1925 | Banby | 48/76 |
| 1,821,263 | 9/1931 | Imbert | 48/76 |
| 1,849,279 | 3/1932 | Cezanne | 48/76 |
| 2,240,702 | 5/1941 | King . | |
| 2,306,030 | 12/1942 | Zeuch | 48/76 |
| 2,513,943 | 7/1950 | Keinanen | 110/229 |
| 3,746,521 | 7/1973 | Giddings | 48/63 |
| 4,134,738 | 1/1979 | Bress et al. | 48/85.2 |
| 4,209,303 | 1/1980 | Ricks | 48/111 |
| 4,274,341 | 1/1981 | Ozaltay | 110/229 |
| 4,306,506 | 12/1981 | Rotter | 110/229 |
| 4,308,103 | 12/1981 | Rotter | 202/117 |
| 4,309,195 | 1/1982 | Rotter | 48/76 |
| 4,321,877 | 3/1982 | Schmidt et al. | 110/186 |
| 4,388,082 | 6/1983 | Guttmann et al. | 48/76 |
| 4,459,136 | 7/1984 | Linneborn et al. | 48/111 |
| 4,498,909 | 2/1985 | Milner et al. | 48/209 |

FOREIGN PATENT DOCUMENTS

| | | | |
|---|---|---|---|
| 874673 | 8/1942 | France | 48/111 |

*Primary Examiner*—Peter Kratz

*Attorney, Agent, or Firm*—Orrin M. Haugen; Thomas J. Nikolai; Frederick W. Niebuhr

[57] ABSTRACT

A gasifier for converting solid organic fuels to combustible gas includes a cylindrical body having insulated side walls and a gas outlet port near its base. Affixed to the top of the cylindrical tank is a conical-shaped fuel feed hopper and beneath it and within the interior of the tank is an inverted truncated one. Positioned beneath the throat of the inverted cone is a pyramidal-shaped grate for supporting the combusting solid fuel during the inversion process. Positioned beneath the grate are a series of baffles. Combustion air is drawn in through the upper portion of the tank near the base of the frusto-conical feed hopper by the action of a motor-driven fan coupled to the gasifier's outlet port. The down draft gas flow reduces noxious fumes and pollutants while the baffles, by increasing the fluid velocity of the gases, tends to make the unit self-cleaning. The design of the hearth cone and grate also eliminates bridging of the fuel during the gasification process.

14 Claims, 2 Drawing Sheets

GASIFIER APPARATUS

BACKGROUND OF THE INVENTION

I. Field of the Invention

This invention relates generally to a device for converting organic material to a combustible gas, and more particularly to the particular design of a small scale gasifier which successfully obviates many of the problems inherent in prior art gasifier equipment.

II. Discussion of the Prior Art

Gasification, as used herein, refers to the production of combustible gases from solid organic material by the application of heat, i.e., pyrolysis. Gasifiers of the general type involved here have been around for over 200 years. During the Industrial Revolution, large quantities of coal were being coked prior to its use in smelting operations. The gas driven off during the coking process was combustible and was used for gas lighting during the early 1800's. Subsequently, gasifiers were designed for use with internal combustion engines. During World War I, with the blockading of oil imports, the German military utilized bolt-on gasifiers as a fuel source for motor vehicles.

Combustion, for purposes of gasification, can be defined as the chemical reaction between oxygen and an organic fuel, i.e., a fuel in which the element carbon is in its chemical makeup. During combustion, the oxygen chemically combines with the fuel to produce new chemical compounds and it is found that the rate of the reaction is dependent on many factors other than the chemical makeup of the fuel itself. For example, the amount of oxygen reaching the fuel has a great effect on combustion rate as does the amount of heat applied to the fuel to liberate the gases necessary for combustion to take place. Another factor is the physical characteristics of the fuel, i.e., its shape and total surface area exposed to oxygen.

Efficient gasification is also dependent upon the manner in which heat liberated during combustion of the fuel is absorbed by yet uncombusted material. Because heat rises, it follows that uncombusted fuel should be placed above the point where combustion is already underway.

Another variable which will alter or affect the properties of combustion lies in the manner in which the oxidizer is introduced to the fuel. The oxidizer, which is usually air, can be brought to the combustion zone from three main directions, i.e., from below, from above or from the sides. Each direction of air flow is found to exhibit its own particular advantages and disadvantages. The natural flow of air is from below. This is because the gases and smoke created by the fire are hotter than the surrounding atmosphere, and, therefore, lighter. This causes them to rise through the combustion zone which, in turn, draws more air in at the bottom to replace it. The advantage of this natural convection air supply is that it is self-feeding and requires no outside impetus to air movement such as a blower. The drawbacks of the natural flow are that tars and other uncombusted by-products are carried off by the exiting gases and smoke creating pollution problems. The tars and by-products also tend to re-condense on the walls of the gasifier unit requiring periodic shutdown for cleanup. Furthermore, the tar substances passing upward through the fuel mass tends to condense out creating a sticky residue on the fuel, inhibiting its ability to flow.

In an attempt to alleviate or eliminate the tar production problem, a number of prior art gasifiers have been designed which deliver combustion air from the sides. In the single side delivery system, the combustion zone takes on the configuration of an elongated ovoid. This proved to be rather counter-productive, in that the cross-sectional configuration of the containment vessel is most often circular. In practice, it means that some uncombusted feed stock will simply move past the sides of the combustion zone and fall into the ash pit. Later, modifications were made to bring combustion air in from a number of discrete directions which gives rise to a combustion zone of overlapping ovoids. For example, if air inlets are positioned 60° apart around the periphery of the combustion zone, each air inlet will only carry 16.6% of the air carried by a single inlet. This leads to radically decreased ovoids which barely overlap. The end-result is, again, poor combustion characteristics.

The side delivery designs permit combustion gases to exit through the uncombusted feed stock, which carried off the tars from the partial pyrolysis. It has been determined that tar production ceases above 700° C. Any tars that are produced above that temperature are quickly decomposed into simpler chemical constituents. Thus, tar that is produced in feed-stocks below the 70° C. limit may be broken down at will by the simple expedient of heating the tar above the 70° C. temperature. Perhaps the simplest way of accomplishing this is to bring combustion air into the fire, or gasifier, from the top. The combustion air carries any tar products and vapors along with it directly into the hot combustion zone of the gasifier. The exit for the combustion gases is through the combustion zone and out the bottom of the fire.

Another problem extant in prior art gasifier designs involves "bridging" where the incoming feed stock builds up in the combustion zone and does not naturally flow as combustion takes place. The practice in dealing with the fuel bridging problem has been to provide mechanical agitators for stirring up the organic material feed stock and breaking up the bridged fuel so that it can continue to flow into the combustion zone. Such mechanical devices need attention and are also subject to frequent repair and replacement.

A successful gasifier system should exhibit the following characteristics:

1. Zero bridging;
2. Minimal maintenance;
3. Minimal down-time for cleaning and/or ash removal; and
4. Usable generated gas, i.e., no tar, no condensate, no particulate matter, no obnoxious emissions.

The system of the present invention possesses all of the above attributes. It is capable of handling a wide range of feed stocks in terms of types and sizes and requires no operator in attendance. The system is capable of running for prolonged periods without the need for periodic shutdowns. It produces no tar, condensates, hydrocarbons or obnoxious emissions and satisfies all EPA guidelines. The invention presents no bridging or feeding problems and drastically reduces clean-up and ash handling. The gasifier itself is totally self-cleaning and all ash generated is deposited in a receptacle without recourse to augers or mechanical devices of any kind. The system of the present invention does not require any down-stream gas clean-up apparatus in that the generated gases are ready to use as they are generated.

SUMMARY OF THE INVENTION

The foregoing features and advantages of the invention are achieved by providing a cylindrical tank body having bottom and side walls consisting of a stainless steel outer jacket, a stainless steel inner jacket and a suitable high temperature insulation material disposed between the two concentric jackets. A refractory brick may also be used to line the interior of the gasifier, both on its bottom and its cylindrical side walls. Projecting from the top of the cylindrical body is a frustoconical feed hopper assembly which also is fabricated from outer and inner stainless steel walls separated by a high temperature insulation. The top of the truncated cone is open and it is through this opening that the organic fuel material is fed.

Located within the cylindrical tank body and inverted beneath the top feed hopper cone is a hearth cone assembly which is bolted to the feed hopper. 8urrounding the base of the feed hopper is an air inlet manifold communicating with a plurality of equally spaced radial holes formed through the base of the conical feed hopper. The incoming air along with the feed stock thus flows through the inverted cone to the combustion zone. In that the hearth cone causes a throttling of the air, its velocity is increased which aids combustion.

A grate assembly is disposed a predetermined distance beneath the throat of the inverted truncated hearth cone member and comprises a pyramidal arrangement of concentric rings which are welded to four main support bars and four intermediate support bars which combine to give the grate its conical profile when viewed from the side. The grate supports the fuel as it is being burned in a controlled oxygen supply environment in an equally distributed fashion.

Located directly beneath the conical grate is a conical baffle which causes the burning fuel particles dropping through the grate to flow toward the walls of the gasifier and from their falling into an ash disposal compartment located at the gasifier body's base. Beneath the conical baffle is a series of three more vertically disposed baffles, each of which comprises an outer cylinder concentric with an inner cylinder and having a series of spiral vanes extending from the outer periphery of the inner cylinder to the inner periphery of the outer cylinder.

Near the base of the gasifier body or tank is a gas outlet connection and this outlet connection is coupled to a vane axial fan or blower. When the blower is operational, it draws outside air through the air manifold surrounding the fuel hopper, through the fuel in the hopper and it moves with an increased velocity through the fuel which is supported by the conical grate. The subsequent passage of the air through the baffles causes the particulate matter (ash) to be steered to a point where it falls into an ash receptacle while the additional baffles create substantial turbulence which reduces the remaining ash particles present in the gas stream to micron size where they become suspended in the exit gas and are effectively burned in the end use device for which the gas is being generated. The baffles perform a further function of increasing the dwell time that the gas remains in the high temperature zone of the gasifier. This increased resident time provides ample time to break down toxic chemicals such as dioxens which may be present in the fuel.

By providing an air intake control, the pyrolysis takes place in a starved oxygen environment insuring that no flame will be present within the gasifier unit itself. The design of the fuel hopper and the grate as well as the relative positioning of the grate relative to the opening in the fuel hopper insures that no bridging of the fuel takes place. Moreover, because the air flow is from top to bottom, tars, creosol and other debris boiled from the fuel does not pass up through the entering fuel supply to create a sticky mass which, as mentioned earlier, was a drawback of certain prior art designs.

OBJECTS

It is accordingly a principal object of the present invention to provide a new and improved gasifier for producing a combustible fuel from organic materials.

Another object of the invention is to provide a gasifier device which obviates problems encountered in prior art designs.

Another object of the invention is to provide a gasifier which requires low maintenance and no full-time operator attendance.

Still another object of the invention is to provide a gasifier unit which is highly efficient in its operation and which is capable of meeting existing EPA regulations relating to air pollution.

A further object of the invention is to provide a continuous feed gasifier in which problems due to fuel bridging are obviated.

A still further object of the invention is to provide a small-scale, low-cost gasifier unit which produces a clean, combustible gas suitable for direct use in many applications without the need for further cleaning procedures.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
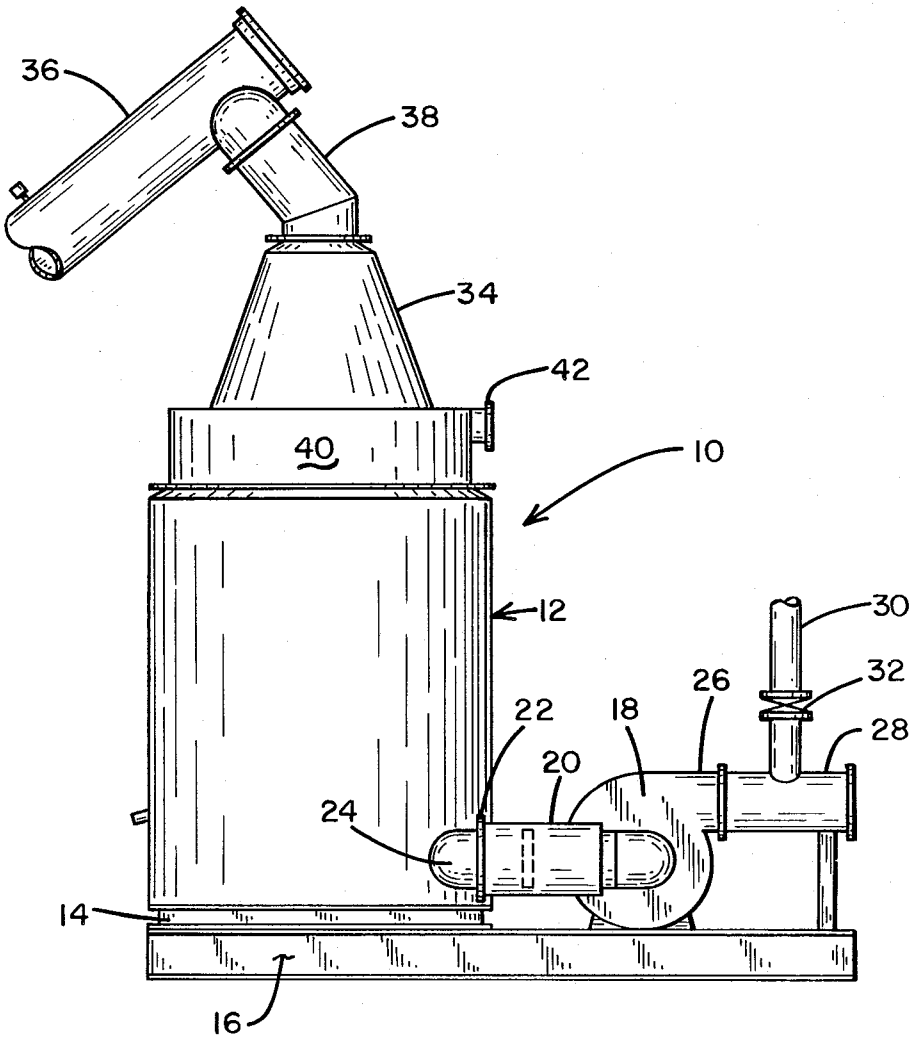
FIG. 1 is a side view of the gasifier unit of the present invention.

Referring first to FIG. 1, there is illustrated a side elevation view of the gasifier embodying the principles of the present invention. The gasifier assembly is indicated generally by numeral 10 and includes a cylindrical tank 12 as a body member which is mounted on a base 14 supported by beams 16. The beams 16 may be a part of a trailer bed for a movable installation or may be stationary. Also mounted on the bed 16 is a motor-driven vane axial blower 18 whose inlet is coupled through suitable duct work 20 to a flange 22 on the gasifier's outlet port 24. The outlet 26 of the blower 18 is coupled through suitable duct work 28 to a gas utilization device, such as a furnace or an internal combustion engine (not shown). Also joined to the gas discharge outlet ductwork 28 is a vent stack 30 having a automatically controlled valve 32 in line with it. As will be pointed out below, the control valve 32 is a safety device allowing the volatile gas generated by the gasifier 12 to be vented to the atmosphere rather than being delivered to the utilization device should, for example, an over-temperature condition develop.

Bolted to the upper end of the cylindrical body 12 is a fuel inlet hopper 34 in the form of a truncated cone. Fuel, such as wood chips, sawdust briquettes, briquetted animal waste, etc., is fed into the gasifier assembly 10 by means of an infeed auger, only a portion of which is shown in FIG. 1 and is identified by numeral 36. The augered fuel drops through an inlet stack 38 and through the open top of the frusto-conical shaped fuel infeed hopper 34. Also attached to the upper end of the body member 12 and surrounding the hopper 34 is an annular combustion air manifold 40.

Figure 2:
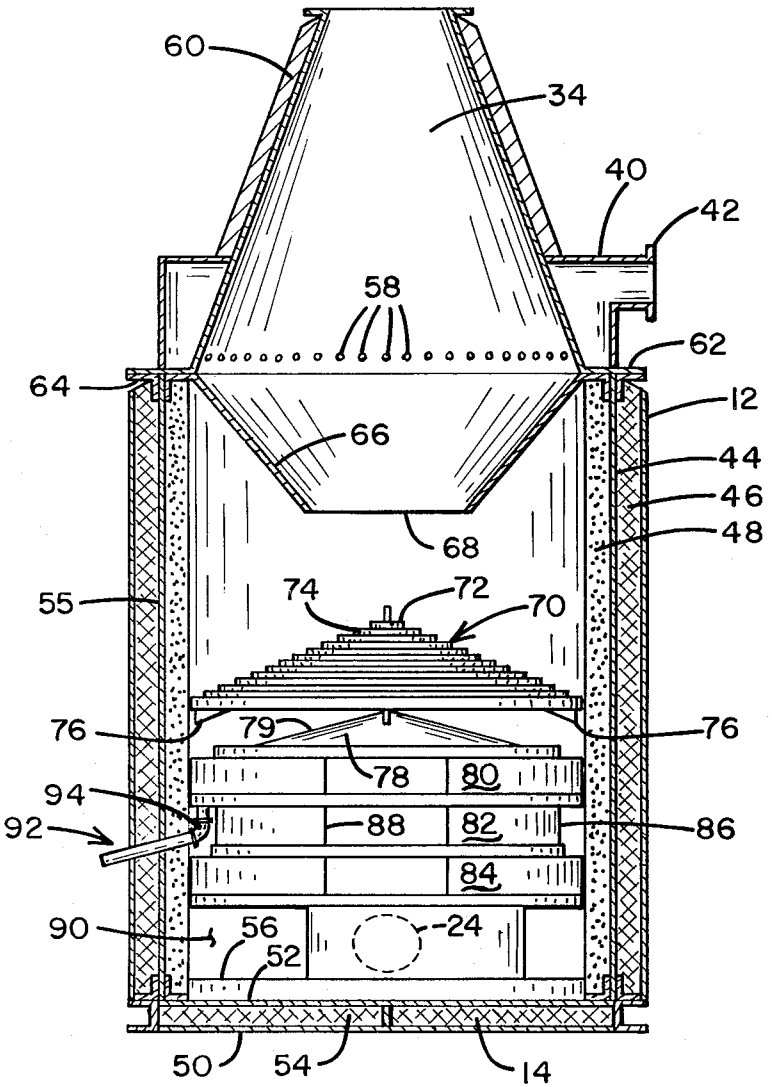
FIG. 2 is a cross-sectional view of the unit of FIG. 1.

Referring next to the cross-sectional view of FIG. 2, it can be seen that the body member 12 includes an inner cylinder 44 which is surrounded on the outside by a ceramic sleeve 46 and which is lined on its inner surface with refractory brick or a ceramic insulation layer. This combination of materials adequately insulates the body 12 so that the outer surface of the body will be safe to touch and so the heat generated during combustion will be contained within the gasifier to increase the conversion efficiency. Typically, the refractory layer 48 and the ceramic layer 46 may each be approximately three inches in thickness.

In a similar fashion, the base 14 comprises first and second circular steel plates 50 and 52 separated by a high temperature ceramic 54 with the upper stainless steel plate 52 also supporting a refractory brick liner 56. Thus, the body member and base are configured to avoid substantial heat loss therethrough.

The infeed hopper 34 is provided with a plurality of air intake ports formed radially 360° around the base thereof and within the confines of the air intake manifold 40. Collectively, the area of the radial air inlet ports 58 equals or exceeds the area of the gas exit port 24 and the air inlet port 42. The infeed hopper 34 is also preferably fabricated from a suitable metal, such as stainless steel, and may be covered with a ceramic layer 60 to limit heat loss therethrough.

Figure 3:
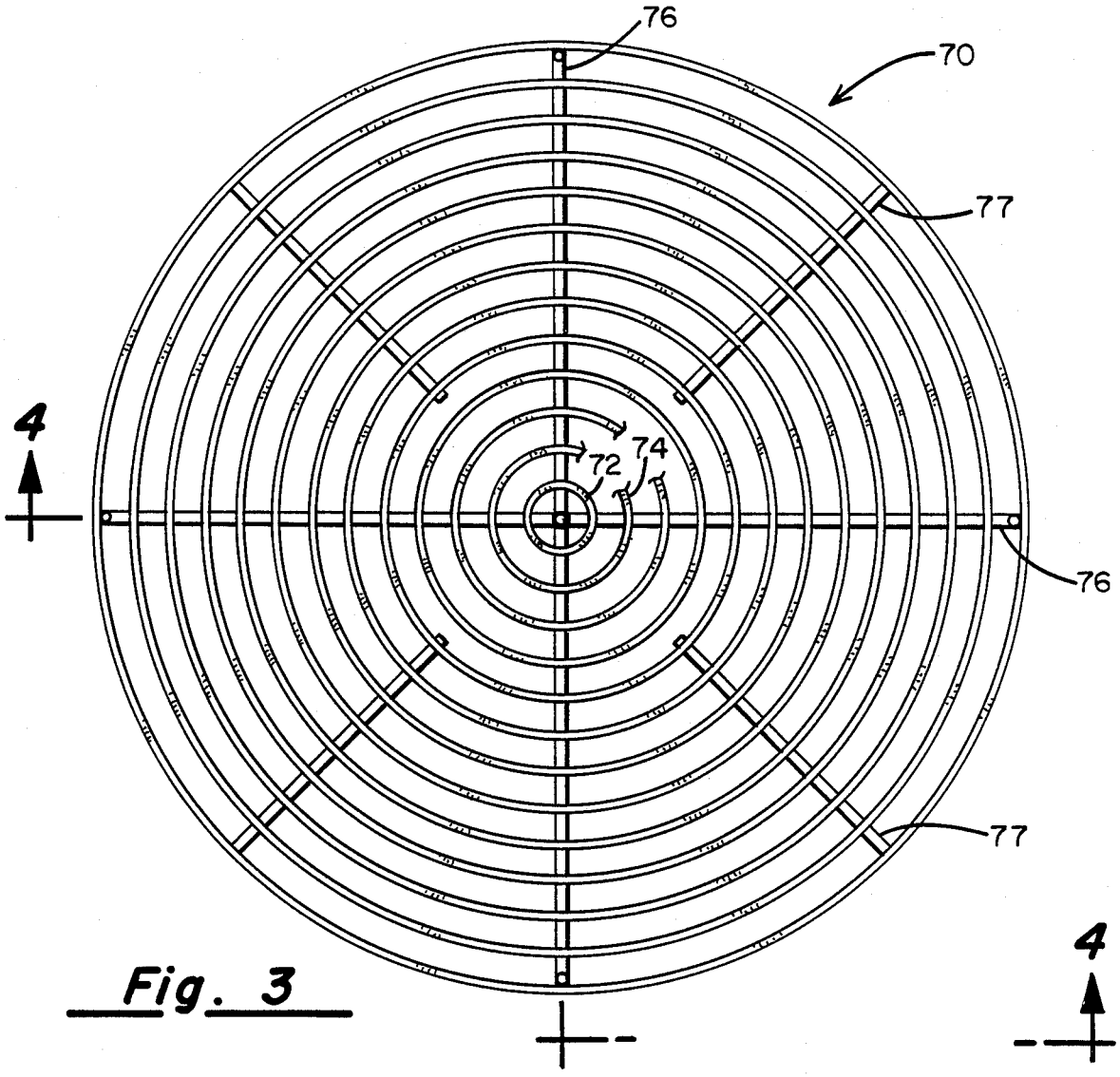
FIG. 3 is a top view of the grate assembly used in the preferred embodiment.

The frusto-conical infeed hopper 34 has an annular flange 62 surrounding its base and this flange is joined to a corresponding annular flange 64 formed around the upper periphery of an inverted frusto-conical member 66 which projects downwardly into the interior of the body member 12. The cone 66 converges to a hearth throat 68 located a predetermined distance above a primary grate 70. As can best be seen in FIGS. 3 and 4, this grate comprises a series of concentric rings 72, 74, etc., supported by four radially extending support bars 76 disposed at 90° intervals. Intermediate supports 77 are interposed midway between the main support bars and, like the main support bars, are welded to the rings 72, 74, etc. Because of the temperatures encountered, it has been found expedient to fabricate the grate rings and supports from type 304 stainless steel, but limitation thereto is not required. As can also be seen in FIG. 4, the support rods 76 and 77 are sloped outwardly and downwardly such that the spaced concentric rings 72, 74, etc., assume a pyramidal configuration. The concentric rings are spaced in such a manner as to block any uncombusted feed stock above a predetermined size from falling through. It is further contemplated that the grate can be fabricated using a supported spiral of titanium wire in place of the stainless steel rings.

Figure 4:
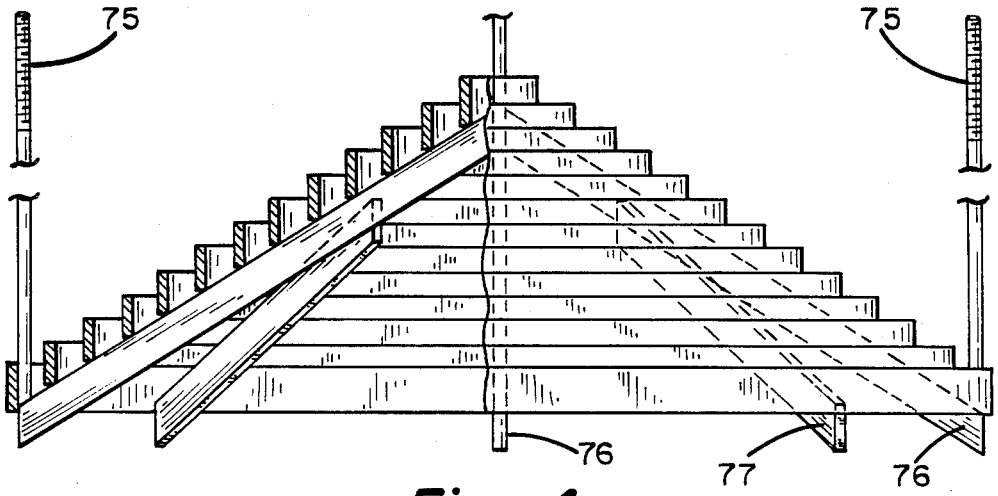
FIG. 4, is a side, partially cross-sectional view of the grate of FIG. 3.

The conically-shaped grate 70 is preferably mounted within the body member 12 so as to be vertically positionable whereby the distance between the grate and the throat 68 of the hearth cone 66 can be adjusted to accommodate different fuels. In this regard, the grate may be suspended from the flange surrounding the lower base of the infeed hopper by threaded rods as at 75 (FIG. 4).

Positioned below the grate 70 are a plurality of baffle members including a primary baffle 78. This baffle has a stainless steel surface 79 which slopes at an angle of about 25° to the horizontal and it results in the diversion of fuel particles falling through the grate to the peripheral edge thereof. Baffle 78 is suspended from the body's side walls by pins (not shown) which leaves a gap between the peripheral edge of the baffle and the I.D. of the body through which fuel particles and ash may fall. Located beneath the conical baffle 78 are a series of three additional baffles 80, 82 and 84, each of which comprises a base plate, an outer cylinder 86 concentric with an inner cylinder 88 and a series of spiral veins which extend from the outer periphery of the inner cylinder 88 to the inner periphery of the outer cylinder 86 so as to create an elongated, torus path to the flow of the combustible gases therethrough. More specifically, baffle 80 has its vanes configured to route the gases generated from the outer edge of baffle 78 to a center opening in the base plate of baffle 80. This has the effect of creating a whirling motion to the gas stream and to increase its velocity. Baffle 82 has no central opening and collects the bases exiting the center of baffle 80. Its vanes direct the gas flow to its outer periphery. In doing so, the gas velocity again decreases. Baffle 84 is similar in design to baffle 80 and again steers the gases to a center opening in its base plate again increasing the gas velocity. Located beneath the lowermost baffle 84 is the gas outlet manifold 90 to which the gas outlet port 24 connects.

Drilled through the base of baffle 80 is a drain hole and screwed into this drain hole is a drain assembly 92 comprising a 45° elbow 94 and an extension pipe passing through the walls of the body 12. Materials, such as glass and non-ferrous metals, contained within the fuel mass are melted in the gasifier and are separated and drained away through the assembly 92.

Having described the general construction of the gasifier in accordance with the present invention, consideration will next be given to its operation.

OPERATION

The organic fuel to be gasified is augered into the fuel hopper 34 on a continuous basis and it is made to fall into the hearth cone 66 where it is mixed with combustion air drawn by the blower 18 through the air inlet 42 and thence through the radial apertures 58 extending through the base portion of the feed hopper 34. The hearth cone 66 is provided to direct the combustion products to the hearth throat 68. Preliminary combustion begins in the interior of the hearth cone 66 with the heat of combustion initiating the pyrolysis process in the as yet uncombusted feed stock. The products of this pyrolysis include carbon dioxide, carbon monoxide, hydrogen, $CH_4$, tars and water vapor.

At the throat 68, the combusting solid organic fuel is guided onto the grate 70. At the same time, the conical constriction in the cross-sectional area functions to increase the gas velocity which thus cooperates to contribute to a high temperature area in and under the throat. By appropriately designing the taper of the hearth cone 66 to approximately 50° to the horizontal, the diameter of the opening defining the throat 68 and the height of the throat 68 above the grate 70, the combusting fuel can be made to uniformly distribute over the surface of the grate 70. The hot coals supported on the grate 70 are held there to insure full combustion of the feed stock and to further the conversion of non-combustible carbon dioxide to combustible carbon monoxide. The finer fuel particles capable of falling through the spacing between the grate rings arrive on the primary baffle 78 where non-combustible $CO_2$ is further converted to combustible CO in the presence of glowing carbon coals and this conversion process is carried out in direct proportion to the time that the carbon dioxide remains in contact with the coals. The baffle 78 also increases the length of the flow path of the exiting gases to increase their resident time within the gasifier which enhances the conversion process. Moreover, the restriction introduced by the baffle increases the velocity of the gases to assist in lifting and carrying of fine cinders and flyash with the gas flow. The further baffles 80, 82 and 84 also serve to increase the residence time of the fine solid fuel particles within the gasifier and the swirling action introduced to the gas stream by the spiral vanes contained within the baffles assists in keeping the baffles and other surfaces impinged upon by the gas flow clean. It is found that the turbulence reduces the flyash to micron size which allows it to be carried with the gas stream, obviating the need for expensive equipment which had to be used with prior art systems to separate out the larger size ash particles from the usable fuel.

The negative taper of the feed cone 66 together with the down drafting resulting when the axial vane blower 18 is coupled to the gas outlet port at the base of the gasifier unit with combustion air being introduced near the top of the body 12 is found to essentially eliminate tar production. Moreover, the tendency for feed stock bridging has been eliminated without the need for complex shakers and mechanical agitators to maintain the continuous flow of fuel into the combustion zone.

Because of the negative down-draft design inherent in the gasifier of the present invention, all hydrocarbons are brought down through the high temperature grate zone and are effectively "cracked" into carbon and various gases.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A gasification apparatus for producing combustible gases from solid organic materials comprising:

(a) a base member;

(b) a generally tubular body member mounted vertically on said base and having an open top;

(c) a feed hopper having downwardly and outwardly sloping sides secured to said open top for receiving said organic materials to be gasified;

(d) an inverted truncated cone disposed within said body member directly beneath said feed hopper for funneling the flow of said organic materials deposited into said feed hopper to a throat area;

(e) means for uniformly introducing combustion air through said feed hopper and said inverted truncated cone to a combustion zone;

(f) grate means disposed beneath said throat area for supporting said organic materials in said combustion zone;

(g) baffle means disposed beneath said grate means in said body member for increasing the dwell time of combustion gases in the high temperature zone of said body member and correspondingly increasing the velocity of gases being drawn through said apparatus;

(h) a gas exit port disposed proximate said base; and (i) blower means coupled to said gas exit port for drawing air through said means for introducing combustion air and through said combustible material supported on said grate means for supporting combustion thereof.

2. The apparatus as in claim 1 wherein said baffle means produces sufficient turbulence in the gas flow stream to inhibit build-up of ash deposits on the surfaces of said gasifier body member.

3. The apparatus as in claim 1 wherein said body member comprises a cylindrical tank having an outer jacket, an inner jacket and a high temperature insulation material disposed therebetween, said inner jacket being lined with a refractory brick.

4. The apparatus as in claim 1 wherein said feed hopper is frusto-conical in shape and has open upper and lower bases.

5. The apparatus as in claim 4 and further including an annular manifold surrounding said frusto-conical shaped feed hopper as its lower base, said annular manifold having an atmospheric air entry port; said manifold operatively joined to said means for uniformly introducing combustion air.

6. The apparatus as in claim 1 wherein said grate means is shaped to cooperate with said feed hopper to prevent bridging of said organic material above said grate means.

7. The apparatus as in claim 1 wherein said grate means comprises a pyramidal arrangement of concentric, spaced-apart rings joined together by radially extending support bars.

8. The apparatus as in claim 1 wherein said baffle means comprises a plurality of annular baffle members which are vertically spaced from one another within said body member and beneath said grate means for agitating.

9. The apparatus as in claim 8 wherein the uppermost one of said baffles is conically shaped and has vanes disposed therein for directing burning organic material particles toward the walls of said body member.

10. The apparatus as in claim 9 wherein at least one further baffle comprises: an outer ring member, a concentrically disposed inner ring member and a plurality of spiral vane segments joining said outer and inner ring members together, said outer and inner ring members being affixed to a base plate.

11. The gasifier apparatus as in claim 1 wherein said organic material is compressed into briquettes prior to being loaded into said feed hopper.

12. The gasifier apparatus as in claim 1 wherein said truncated cone is configured to increase the velocity of the gases flowing onto the grate to facilitate combustion of said organic materials supported above said grate.

13. The gasifier apparatus as in claim 5 wherein said annular manifold includes means for metering the volume of air introduced into said body member.

14. The gasifier apparatus as in claim 1 and further including means for adjusting the vertical distance between said throat area and said grate means.

* * * * *